US007206258B1

(12) United States Patent
Fisher et al.

(10) Patent No.: US 7,206,258 B1
(45) Date of Patent: Apr. 17, 2007

(54) DUAL RESPONSE ACOUSTICAL SENSOR SYSTEM

(75) Inventors: Stanley A. Fisher, Boyds, MD (US); Gideon Maidanik, Arlington, VA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 149 days.

(21) Appl. No.: 11/108,144

(22) Filed: Apr. 13, 2005

(51) Int. Cl.
*G10K 11/168* (2006.01)

(52) U.S. Cl. ..... 367/141

(58) Field of Classification Search ..... 367/141
See application file for complete search history.

(56) References Cited

U.S. PATENT DOCUMENTS

| | | | |
|---|---|---|---|
| 3,274,539 | A | 9/1966 | Sykes |
| 3,311,873 | A | 3/1967 | Schloss |
| 3,563,845 | A | 2/1971 | Stevens |
| 3,894,165 | A | 7/1975 | Bates |
| 3,988,620 | A | 10/1976 | McDavid |
| 4,139,613 | A | 2/1979 | Hefele |
| 4,431,873 | A | 2/1984 | Dunn et al. |
| 4,538,250 | A | 8/1985 | De Metz et al. |
| 4,633,119 | A | 12/1986 | Thompson |
| 4,684,888 | A | 8/1987 | Tabak |
| 4,701,614 | A | 10/1987 | Jaeger et al. |
| 4,716,556 | A | 12/1987 | Raskin et al. |
| 4,800,542 | A | 1/1989 | Franklin et al. |
| 4,833,659 | A | 5/1989 | Geil et al. |
| 4,950,936 | A | 8/1990 | Rynne et al. |
| 4,958,329 | A | 9/1990 | Marschall |
| 4,958,331 | A | 9/1990 | Wardle |

(Continued)

FOREIGN PATENT DOCUMENTS

| | | |
|---|---|---|
| GB | 1152742 | 5/1969 |

OTHER PUBLICATIONS

Gideon Maidanik and K. J. Becker, "Normalized Outputs to Turbulent Boundary Layer (TBL) of Pressure and Velocity Transducers and Their Sensitivities," NSWCCD-70-TR-2000/037, face-dated Mar. 2000, Naval Surface Warfare Center, Carderock Division, West Bethesda, Maryland, 164 pages.

(Continued)

*Primary Examiner*—Dan Pihulic
(74) *Attorney, Agent, or Firm*—Howard Kaiser

(57) ABSTRACT

An array of pressure sensors and motions sensors is contained in a layered material system that includes an acoustically compliant layer and an acoustically transparent layer. The compliant layer (which vibrates in accordance with acoustical influence thereupon) is the foundation for both sensor types and is the vibratory medium for motion sensing. The transparent layer is the matrix for both sensor types and is the window permitting sound waves to reach the pressure sensors (which sense pressure of the sound waves) and the compliant layer (the vibration of which is sensed by the motion sensors). The compliant layer's exposed surface can be attached to a structure's exterior for passive sonar detection purposes. Since the pressure sensors are effective primarily for low frequency sound waves, and the motion sensors are effective primarily for high frequency sound waves, the invention is aggregately effective for a broad band spanning low and high frequencies.

19 Claims, 7 Drawing Sheets

U.S. PATENT DOCUMENTS

| | | | | |
|---|---|---|---|---|
| 4,974,213 | A | 11/1990 | Siwecki | |
| 4,976,902 | A | 12/1990 | Oberle | |
| 5,046,055 | A | 9/1991 | Ruffa | |
| 5,130,948 | A | 7/1992 | Laukien et al. | |
| 5,140,559 | A | 8/1992 | Fisher | |
| 5,144,597 | A | 9/1992 | Lagier et al. | |
| 5,155,707 | A | 10/1992 | Fisher | |
| 5,164,919 | A | 11/1992 | Scanlon et al. | |
| 5,345,522 | A | 9/1994 | Vali et al. | |
| 5,367,501 | A | 11/1994 | Kelly et al. | |
| 5,377,163 | A | 12/1994 | Simpson | |
| 5,392,258 | A | 2/1995 | Gabrielson et al. | |
| 5,472,541 | A | 12/1995 | Simmons et al. | |
| 5,504,716 | A | 4/1996 | Cotterill | |
| 5,541,894 | A | 7/1996 | Erath | |
| 5,554,214 | A | 9/1996 | Supcoe et al. | |
| 5,602,801 | A | 2/1997 | Nussbaum et al. | |
| 5,657,296 | A | 8/1997 | Carter | |
| 5,675,556 | A | 10/1997 | Erath et al. | |
| 5,677,894 | A | 10/1997 | Erath | |
| 5,696,736 | A | 12/1997 | Fisher | |
| 5,717,658 | A | 2/1998 | Carter | |
| 5,719,824 | A | 2/1998 | Boucher | |
| 5,737,279 | A | 4/1998 | Carter | |
| 5,757,724 | A | 5/1998 | Wilson et al. | |
| 5,757,725 | A | 5/1998 | Wilson et al. | |
| 5,789,844 | A | 8/1998 | de Groot | |
| 5,800,536 | A | 9/1998 | Fisher et al. | |
| 5,808,970 | A | 9/1998 | Nussbaum et al. | |
| 5,815,466 | A | 9/1998 | Erath | |
| 5,822,276 | A | 10/1998 | Miklovic | |
| 5,903,349 | A | 5/1999 | Vohra et al. | |
| 5,930,201 | A | 7/1999 | Cray | |
| 6,046,963 | A | 4/2000 | Glenning | |
| 6,052,335 | A | 4/2000 | Korolenko | |
| 6,056,032 | A | 5/2000 | Vohra et al. | |
| 6,160,763 | A | 12/2000 | Cole | |
| 6,172,940 | B1 | 1/2001 | McConnell et al. | |
| 6,229,762 | B1 | 5/2001 | Fisher et al. | |
| 6,262,944 | B1 | 7/2001 | Meyer et al. | |
| 6,328,837 | B1 | 12/2001 | Vohra et al. | |
| 6,370,085 | B1 | 4/2002 | Finkle et al. | |
| 6,404,106 | B1 | 6/2002 | Dale et al. | |
| 6,408,978 | B1 | 6/2002 | Premus | |
| 6,438,070 | B1 | 8/2002 | Birchak et al. | |
| 6,473,365 | B2 | 10/2002 | Joh et al. | |
| 6,516,652 | B1 | 2/2003 | May et al. | |
| 6,527,991 | B1 | 3/2003 | Bakker et al. | |
| 6,563,762 | B1 | 5/2003 | Williams | |
| 6,606,959 | B1 | 8/2003 | Shen | |
| 6,657,365 | B1 * | 12/2003 | Ambs | 310/339 |
| 2004/0265567 | A1 | 12/2004 | Janzen | |

OTHER PUBLICATIONS

Francois M. Guillot and D. H. Trivett, "A Dynamic Young's Modulus Measurement System for Highly Compliant Polymers," *Journal of the Acoustical Society of America*, vol. 114, No. 3, pp. 1334-1345 (Sep. 2003).

Steve Finley, "NSWC and NUWC Reach 15-Year Towed Array Teaming Milestone," *Wavelengths Online*, United States Navy, Aug. 31, 2004; online, article at http://www.dt.navy.mil/wavelengths/archives/000102.html, 2 pages printed out on Jan. 4, 2005.

Monmouth Rubber and Plastics Corp., 75 Long Branch Avenue, Long Branch, New Jersey, 07740; online, home page at http://www.monmouth-rubber.com/, 2 pages printed out on Mar. 15, 2006.

Rubatex International, LLC, 906 Adams Street, Bedford, Virginia, 24523; online, home page at http://www.rubatex.com/, 1 page printed out on Mar. 15, 2006.

Air Products and Chemicals, Inc., 7201 Hamilton Boulevard, Allentown, Pennsylvania, 18195; online, home page at http://www.airproducts.com/index.asp/, 1 page printed out on Mar. 15, 2006.

Air Products and Chemicals, Inc., 7201 Hamilton Boulevard, Allentown, Pennsylvania, 18195; online, "Versathane®" web page at http://www.airproducts.com/Products/Chemicals?PSP/psp-ProductLines/versathane.htm, 2 pages printed out on Mar. 15, 2006.

J. M. Cuschieri and D. Feit, Influence of Circumferential Partial Coating on the Acoustic Radiation from a Fluid-Loaded Shell,), *Journal of the Acoustical Society of America*, vol. 107, No. 6, pp. 3196-3207 (Jun. 2000).

John W. Doane, David H. Trivett, Jacek Jarzynski, "Nondestructive Evaluation of Conformal Sonar Hull Array Manufacture and Installation" (Abstract), *Journal of the Acoustical Society of America*, vol. 112, No. 5, pt. 2, p. 2408 (Nov. 2002).

Benjamin A. Cray, Ashwin Sarma, Ivar P. Kirsteins, "High-Frequency Laser Sonar System" (Abstract), *Journal of the Acoustical Society of America*, vol. 112, No. 5, pt. 2, p. 2408 (Nov. 2002).

Francois M. Guillot and David H. Trivett, "Development of a Dynamic Young's Modulus Measurement System for Compliant Polymers" (Abstract), *Journal of the Acoustical Society of America*, vol. 112, No. 5, pt. 2, p. 2408 (Nov. 2002).

Dorothee Callens, Christian Brunceel, Jamal Assaad, "Matching of Ultrasonic Transducer: Interest of the Glue Layer" (Abstract), *Journal of the Acoustical Society of America*, vol. 112, No. 5, pt. 2, pp. 2408 (Nov. 2002).

Georgia Institute of Technology, Woodruff School of Mechanical Engineering; Karl A. Fisher, "Ph.D. Thesis Defense," dated "Tuesday, Mar. 17, 1998," Ph.D. thesis entitled "Modeling the Acoustic Response of Motion Sensors Mounted on a Compliant Fluid-Loaded Coating," Abstract (of Ph.D. thesis) online at http://www.me.gatech.edu/me/theses/Fisher.html, 1 page printed out on Aug. 8, 2003.

Georgia Institute of Technology, Woodruff School of Mechanical Engineering; "Peter H. Rogers, Rae and Frank H. Neely Chair in Mechanical Engineering," article online at http://www.me.gatech.edu/me/publicat/brochures/rb/Rogers.html, 1 page printed out on Aug. 8, 2003.

*DefenseLink* website, U.S. Department of Defense; Contract No. 469-99 dated Oct. 6, 1999, article online at http://www.defenselink.mil/contracts/1999/c10061999_ct469-99.html, 2 pages printed out on Jan. 5, 2005.

* cited by examiner

DUAL RESPONSE ACOUSTICAL SENSOR SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to underwater acoustics, more particularly to methods and apparatuses, such as used in association with marine vessels, for effecting passive sonar to detect or locate underwater objects.

According to typical current practice of passive sonar by the United States Navy, broadband coverage is provided by a combination of: (i) one or more hull arrays of sonar sensors (hull-mounted, e.g., mounted conformally on the body and/or on the bow); and, (ii) one or more towed arrays of sonar sensors. The towed sensor arrays provide the performance at low frequencies, but their handling and maintenance make them impractical under some conditions. A towed sensor array also suffers because it cannot discriminate between contacts on the right or left of the array.

Some marine vessels are provided on their hull exteriors with mechanically compliant coatings. These mechanically compliant coatings are sometimes referred to simply as "compliant" coatings, and are also referred to as "flexible" or "soft" coatings. A mechanically compliant coating is typically an outside hull coating that is characterized by a significant degree of elasticity (e.g., viscoelasticity). A mechanically compliant hull coating, typically composed of a polymeric (e.g., elastomeric) material, tends to restrict or impede the attachment of instrumentation to the hull. Typical hull-mounted acoustical sensors require complex and expensive baffling, as it is impractical to directly couple the sensors with the mechanically compliant coatings. The baffles serve to reduce the effects of the ship's noise on the sensors, but are undesirably limiting in terms of size and frequency coverage of the sensors.

SUMMARY OF THE INVENTION

In view of the foregoing, it is an object of the present invention to provide an improved passive sonar methodology for practice in association with marine vessels such as naval ships and submarines.

The present invention provides a unique system for affording broadband passive sonar capability. Many embodiments of the present invention provide a sensor array system characterized by broad frequency coverage and covering all or part of the entire length and width of a naval vehicle or structure. A typical acoustical sensing system in accordance with the present invention includes an acoustically compliant material, an acoustically transparent material, and an array of sensors including one or more pressure sensors and one or more motion sensors (e.g., accelerometers or velocimeters or hydrophone pairs). The hull mountings of acoustical sensors conventionally involve costly, complicated baffling configurations in order to reduce same-ship noise effects on the sensors. The present invention provides a layer of acoustical compliance, which facilitates sensor placement anywhere on the ship. Multifarious inventive applications are possible, mere examples of which include those involving attachment of an inventive layered system to the outside of a marine hull, and those involving stand-alone suspension of an inventive layered system in the water at a defensively strategic location.

Terms such as "acoustically compliant material," "acoustically compliant coating" and "acoustically compliant layer" are synonymously used herein to refer to a material, coating or layer in which, at acoustical frequencies, the displacement (or velocity) on one surface of the material, coating or layer may be unequal to the displacement (or velocity) on the other (e.g., opposite) surface of the material, coating or layer. Generally speaking, acoustical compliance implies mechanical compliance, whereas mechanical compliance does not imply acoustical compliance. In other words, as general rules, all acoustically compliant materials are mechanically compliant materials, whereas some but not all mechanically compliant materials are acoustically compliant materials. Depending on the embodiment, the present invention's acoustically compliant coating can be designed to be, as well, a mechanically compliant coating having selected mechanical compliance properties. That is, the present invention's acoustically compliant material can be designed to afford, not only acoustical compliance in a desired manner, but also mechanical compliance (e.g., mechanical flexibility or mechanical softness) in a desired manner.

The present invention is frequently embodied as acoustical sensing apparatus that may be suitable for use in association with any kind of structure, natural or man-made, as may be selected in accordance with a given inventive application. According to typical inventive applications the inventive acoustical sensing apparatus is used on the hull of a marine vehicle such as a ship or submarine. According to other applications of the present invention, the inventive acoustical sensing apparatus is used, for instance, in association with marine docks, or seawalls, or amphibious vehicles, or various other kinds of structures. The inventive acoustical sensing apparatus comprises a laminar sheet, at least one motion sensor and at least one pressure sensor. The laminar sheet includes an acoustically compliant layer and an acoustically transparent layer. Each pressure sensor and each motion sensor is embedded in the acoustically transparent layer. Each pressure sensor is capable of sensing pressure of sound waves encountered by the pressure sensor, thereby generating an electrical signal in response to the pressure. Each motion sensor is capable of sensing vibration of the acoustically compliant layer, thereby generating an electrical signal in response to the vibration. The vibration of the acoustically compliant layer is associated with sound waves encountered by the acoustically compliant layer. Each motion sensor is connected to the acoustically compliant layer in order to sense the vibration of the acoustically compliant layer. Collectively and perhaps also individually, depending on the inventive embodiment, the at least one pressure sensor is capable of sensing the pressure of sound waves in a first continuous frequency range. Collectively and perhaps also individually, depending on the inventive embodiment, the at least one motion sensor is capable of sensing the acoustically compliant layer's vibration that is associated with sound waves in a second continuous frequency range, at least a portion of which is higher than the first continuous frequency range. The combination of the first continuous frequency range and the second continuous frequency range establishes a continuous broadband frequency range. Inventive practice often provides for an adhesive layer for disposition between the acoustically compliant layer and the surface, or a portion of the surface, of a (typically, rigid) structure such as a ship hull, submarine hull, aircraft hull, etc.

The inventive system typically includes a double-layered material system consisting of two adjacent material layers, viz., an acoustically compliant material layer and an acoustically transparent material layer. The sensors (at least one pressure sensor and at least one motion sensor) are mounted upon the acoustically compliant material layer and are embedded within the acoustically transparent material layer. The inventive double-layered material system is suitable for covering a marine hull (usually made of a rigid material, e.g., steel or other metal material, or a composite material) so as to form a multi-layered material system that includes three (or four) adjacent material layers. The three main layers are a hull material layer as the inside layer, an acoustically compliant material layer as the middle layer, and an acoustically transparent material layer as the outside layer. A flat, smooth surface of the acoustically transparent material layer is exposed to the water. According to many inventive embodiments, a fourth, relatively thin layer is present, viz., a bonding or adhesive material layer (e.g., polyurethane), for adhering the acoustically compliant material layer to the hull material layer.

The sound waves reach the motion sensors and pressure sensors unimpeded (or substantially unimpeded) by the acoustically transparent material layer. The acoustically compliant material exhibits a vibratory response to sound waves at a higher range of frequencies. The motion sensors sense the vibratory response of the acoustically compliant material to the sound waves at the higher range of frequencies, thereby being indicative of the higher frequency sound waves (or at least one characteristic of the higher frequency sound waves). The pressure sensors sense the pressure associated with the sound waves at a lower range of frequencies, thereby being indicative of the lower frequency sound waves (or at least one characteristic of the lower frequency sound waves). Together, the motion sensors cover a broad range of frequencies that includes the lower range of frequencies (covered by the pressure sensors) and the higher range of frequencies (covered by the motion sensors). Often in inventive practice, there is the frequency range in which both pressure sensors and motion sensors function adequately. According to some such embodiments characterized by dual sensory effectiveness in an intermediate frequency range, additional sonar performance can be gained by multiplying the pressure sum beam by the motion sum beam, in this intermediate frequency range.

Accordingly, the present invention represents an integrated broadband sensor system that uses the combined effects of a compliant coating, pressure sensors and motion sensors (e.g., accelerometers, or velocimeters, or paired pressure sensors) to provide broad frequency coverage. At low frequencies, the pressure sensor is effective because the acoustically compliant coating is ineffective (resulting in measurable pressure). At high frequencies, the motion sensor (e.g., accelerometer or velocimeter) is effective because the acoustically compliant coating translates all incoming signals to motion at the face of the acoustically compliant coating (resulting in minimal pressure but measurable motion, e.g., speed, velocity or acceleration). The lower frequency range (i.e., the range of operability of the pressure sensors) and the higher frequency range (i.e., the range of operability of the motion sensors) meet (e.g., contact, intersect or overlap) so as to form, overall, a continuous range of sensor operability that includes both the lower frequency range and the higher frequency range.

Featured by the present invention is the direct coupling of sensors with an acoustically compliant hull coating in a structurally and hydrodynamically sound manner so as to take functional advantage of the "acoustical compliancy" of the acoustically compliant hull coating. Advantageously, the sensors are attached to the acoustically compliant hull coating in the absence of baffling or other auxiliary structure that may carry additional costs and complexities as well as hydrodynamic and acoustic penalties. In addition, the present invention as typically practiced offers the inherent benefit of the integration of sensors with the marine hull itself, which is generally preferable (with respect to lateral sensing as well as under some operating conditions) to the use of sensors in a towed arrangement. The present invention's new sensor system can be practiced regardless of whether or not an acoustically compliant coating is already installed on a structure such as a marine hull. In other words, if an acoustically compliant coating is present, it can be inventively availed of; if the acoustically compliant coating in not present, it can be inventively provided for. For instance, the inventive system can be installed in place of or over an existing coating that is not acoustically complaint, or can be installed inclusively of a coating that is acoustically compliant.

The pressure sensors and motion sensors as normally practiced according to the present invention are transducers. The term "pressure sensor" is conventionally understood to refer to a device that generates an electrical signal in response to pressure. The term "motion sensor" is conventionally understood to refer to a device that generates an electrical signal in response to motion. The term "pressure sensor" is used herein synonymously with the term "hydrophone," each term broadly referring to a device that generates an electrical signal in response to acoustic pressure. The term "motion sensor" is used herein synonymously with the term "geophone," each term broadly referring to a device that generates an electrical signal in response to vibratory motion (vibration).

A motion sensor or geophone can be, according to inventive practice, any of variety of devices that represent motion-sensing means. Many inventive embodiments provide for utilization of velocimeters, or accelerometers, or hydrophone pairs, or some combination thereof, for motion sensing purposes. A motion sensor (geophone) can comprise two pressure transducers, closely spaced, which are combined in opposite phase. This "paired hydrophone device" (or "paired pressure sensor device"), which includes two pressure sensors (hydrophones) that are proximately situated and that operate in an oppositely phased manner, functions as a motion sensor. A combination including in-phase pressure sensors would function as a pressure sensor. It may be advantageous in some inventive embodiments to use only one sensor type, namely, pressure sensors, to afford both the pressure sensing and the motion sensing capabilities; according to such embodiments, some pressure sensors would perform pressure sensing, while other pressure sensors would be arranged in pairs so as to perform motion sensing. It would even be possible to selectively implement paired pressure sensors for either pressure sensing or motion sensing by adjusting phases.

Compliant materials of a mechanically compliant variety are characterized by "compliancy" insofar as tending to be mechanically influenced by one or more kinds of external forces. An elastic body, for instance, can be mechanically influenced so as to vibrate and/or change shape. Mechanically compliant materials have been investigated for various purposes, including drag reduction, vibration damping and noise reduction. The compliant materials of interest in the present invention are of an acoustically compliant variety. An acoustically compliant entity is characterized, at one or more acoustical frequencies, by inequality of sound displacement or sound velocity at two different surfaces of the entity. Regardless of their other properties, acoustically compliant objects exhibit certain behavior in response to certain acoustical stimuli (e.g., sound waves of particular frequencies). Many materials that are useful for inventive practice as being acoustically compliant also happen to be mechanically compliant.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
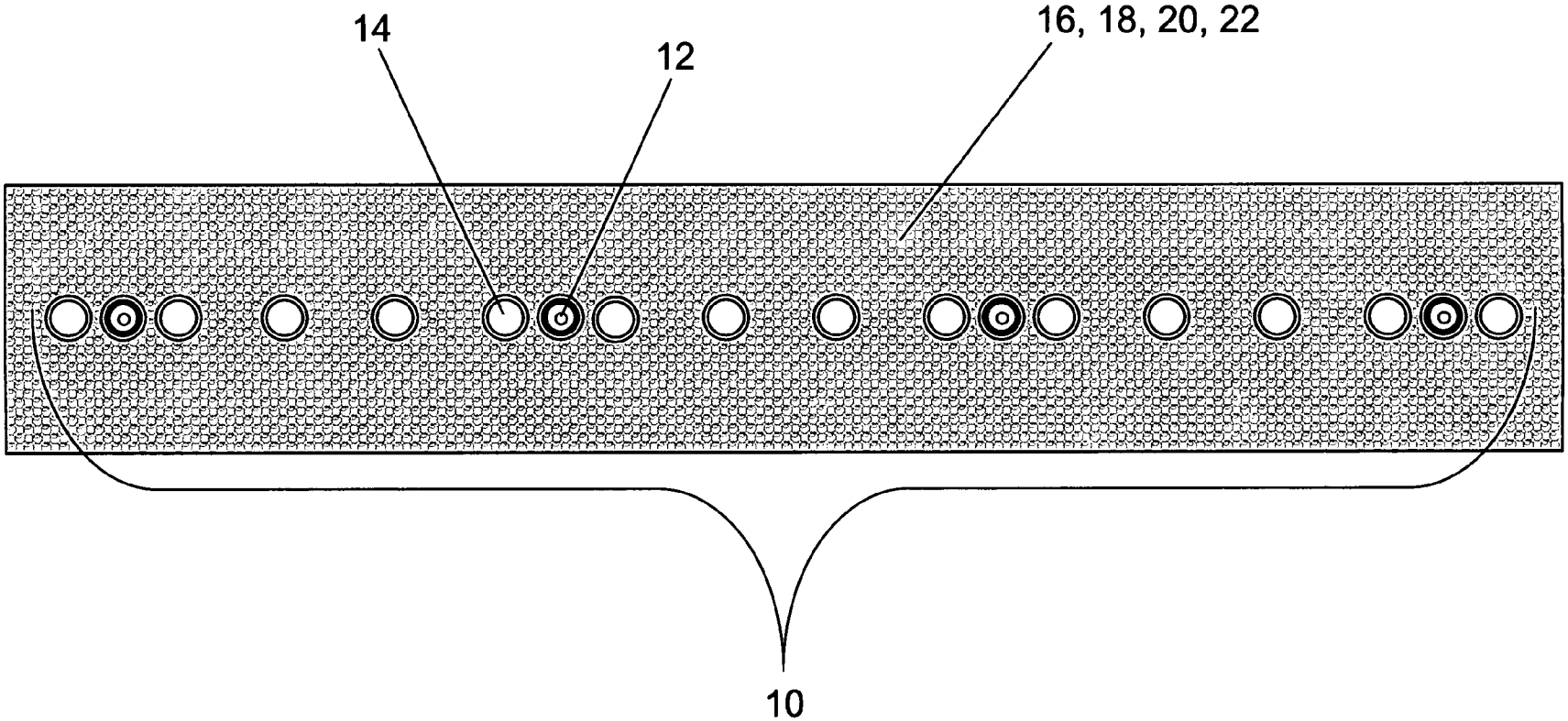
FIG. 1 is a diagrammatic view (an elevation view with respect to a portion of a ship hull) of an embodiment of a passive sonar array in accordance with the present invention.
Figure 2:
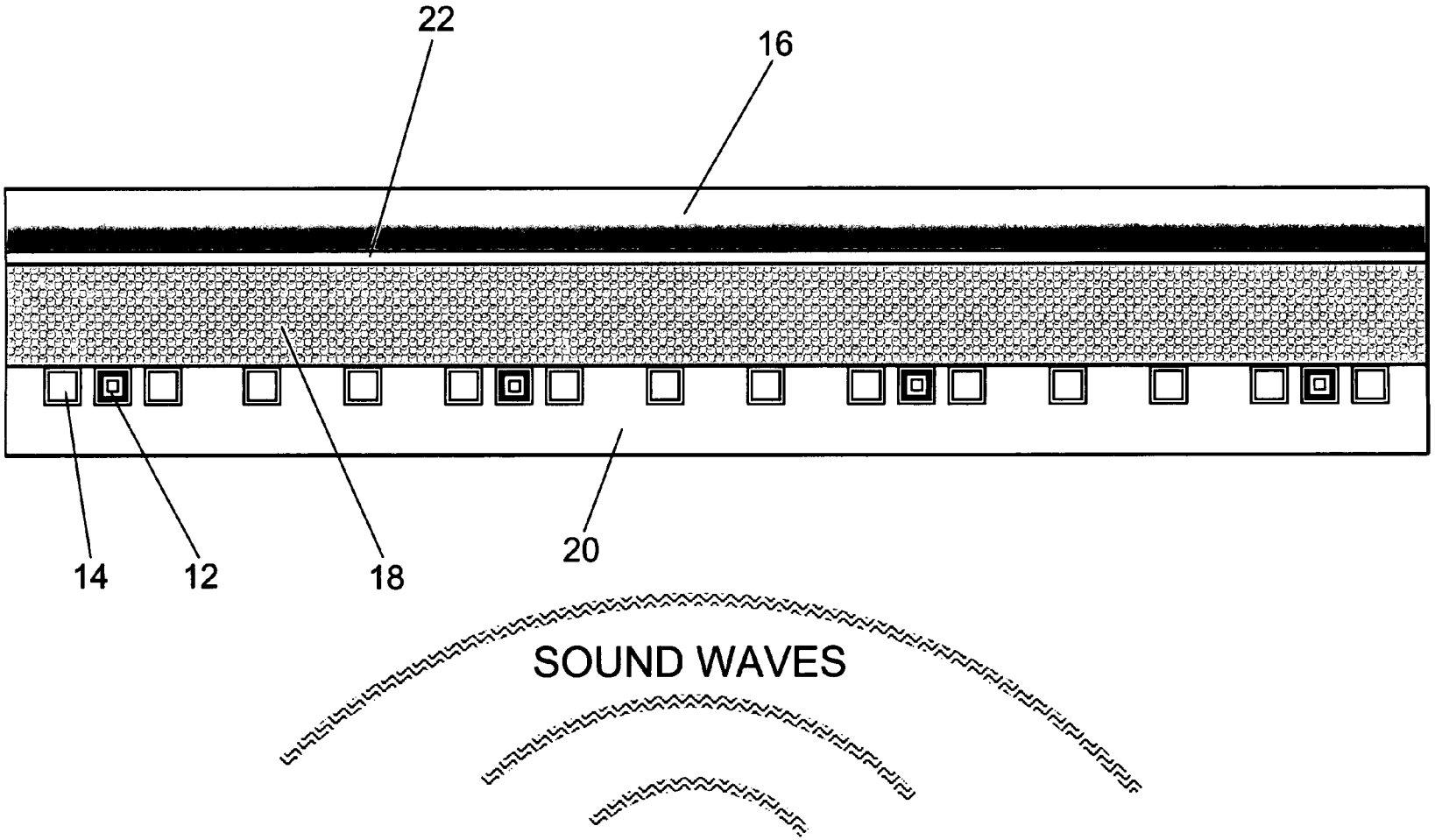
FIG. 2 is a diagrammatic view (a top plan view with respect to the portion of the ship hull) of the inventive embodiment shown in FIG. 1.

Referring now to FIG. 1 and FIG. 2, sensor array 10 includes hydrophones (pressure sensors) 12 and geophones (motion sensors) 14. Hydrophones 12 (four shown in FIG. 1 and FIG. 2) and geophones 14 (fourteen shown in FIG. 1 and FIG. 2) are arrayed along the side of a steel ship hull 16. All of the hydrophones 12 and geophones 14 of array 10 are mounted upon an acoustically compliant layer 18 made of a voided (cellular) neoprene material. Adjacent to acoustically compliant layer 18 is acoustically transparent layer 20, made of a polycarbonate material. Acoustically transparent layer 20 surrounds sensor array 10, serving as a kind of matrix for containing hydrophones 12 and geophones 14. Polyurethane adhesive layer 22 bonds acoustically compliant layer 18 to ship hull 16.

In inventive practice the acoustically compliant material is, rather than solid, more frequently cellular, for instance a closed-cell foam, a "sponge rubber" or a voided elastomer. An example of an acoustically compliant material appropriate for many inventive embodiments is a closed-cell foam neoprene, commercially available forms of which are Durafoam™ (manufactured by Monmouth Rubber and Plastics Corp., 75 Long Branch Avenue, Long Branch, N.J., 07740) and Rubatex® (manufactured by RBX Industries, Inc., 5221 Valley Park Drive, Roanoke, Va., 24019).

The present invention's acoustically transparent material can be either elastomeric or non-elastomeric. The acoustically transparent material is typically a clear, tough (e.g., impact resistant), dimensionally stable material, such as a plastic (thermoplastic or thermosetting) or rubber (natural or synthetic) material. For instance, a thermoplastic material such as a polycarbonate (PC), or a thermosetting material such as neoprene or other synthetic rubber, or a natural rubber, may be suitable for inventive practice. According to many inventive embodiments, the acoustically transparent material has a hydrodynamically propitious quality, affording a smooth exterior surface that promotes the decoupling of flow with respect to the marine hull. Among the concomitant benefits are lower hydrodynamic drag and lower flow noise. The smooth exterior surface lowers noise generated by flow over the ship, especially at mid and higher ship speeds.

The bonding material can be any suitable material having adhesive qualities, for instance a polyurethane material such as Versathane® (manufactured by Air Products and Chemicals, Inc., 7201 Hamilton Boulevard, Allentown, Pa., 18195). The U.S. Navy's Conformal Array Velocity (Sonar) Sensors ("CAVES") program provides for an array of accelerometers that are mounted on a compliant layer. The acoustically compliant layer is adhered to a hull via a layer of Versathane® that is approximately one inch thick. See John W. Doane, David H. Trivett, Jacek Jarzynski, "Nondestructive evaluation of conformal sonar hull array manufacture and installation" (Abstract), *Journal of the Acoustical Society of America*, vol. 112, no. 5, pt. 2, page 2408 (November 2002), incorporated herein by reference.

Figure 3:
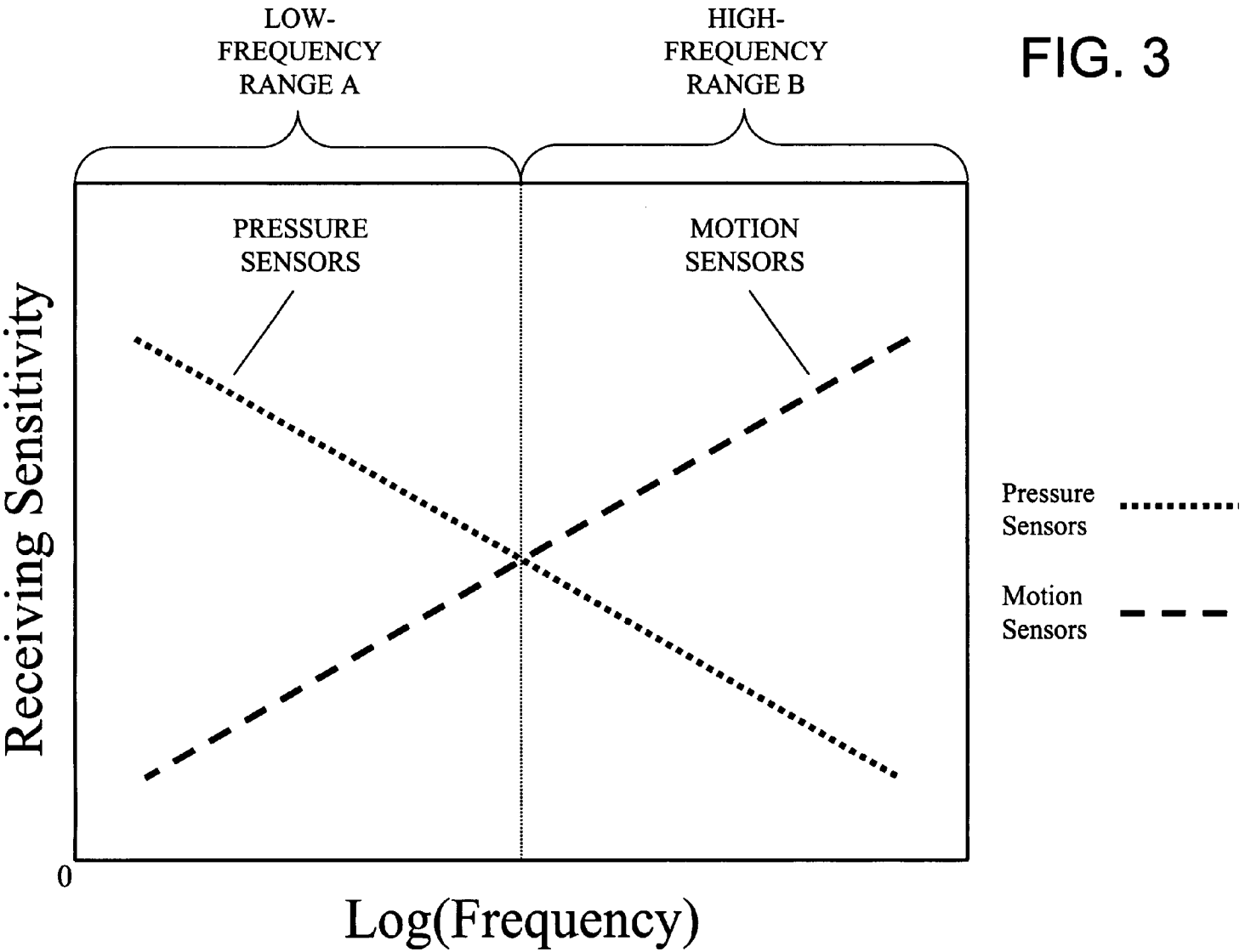
FIG. 3 and FIG. 4 are graphs illustrating typical respective relationships, for a pressure sensor (shown with a negatively sloped linear plot) and a motion sensor (shown with a positively sloped linear plot), between a sensor's receiving sensitivity to an incident signal (y-axis) and the sound wave frequency (logarithmically expressed) of the incident signal x-axis).
Figure 4:
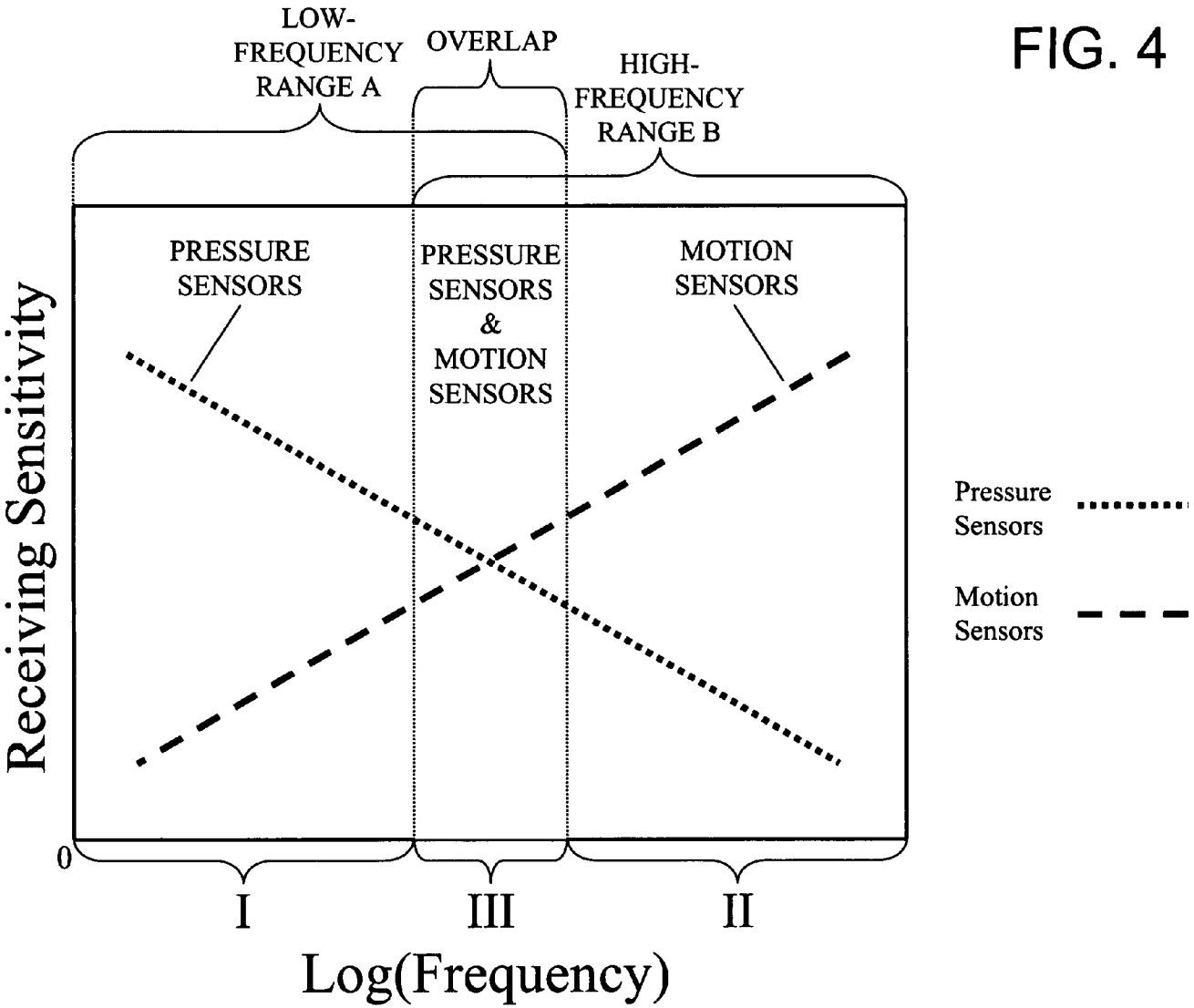

Still with reference to FIG. 1 and FIG. 2 and also with reference to FIG. 3 and FIG. 4, hydrophones 12 and geophones 14 each generate an electrical signal that is indicative as to the existence or nature of sound waves that are propagating through the water in the vicinity of ship hull 16. Hydrophones 12 measure the acoustical pressure of sound waves interacting with hydrophones 12. Geophones 14 measure the vibration of acoustically compliant layer 18, such vibration caused by interaction of sound waves with acoustically compliant layer 18. Together the hydrophones 12 and the geophones 14 have a "dual frequency" quality, as the hydrophones 12 detect pressure occasioned by sound waves residing in a lower frequency band, whereas geophones 14 detect acoustically compliant layer 18 vibrations occasioned by sound waves residing in a higher frequency band.

Incorporated herein by reference is Francois M. Guillot and D. H. Trivett, "A dynamic Young's modulus measurement system for highly compliant polymers," *Journal of the Acoustical Society of America*, vol. 114, no. 3, pages 1334–1345 (September 2003). Guillot et al. discuss their findings (e.g., concerning vibratory behavior) with regard to two commercially available materials, viz., Rubatex® R451N and Goodrich Torodin™ AQ21. When Guillot et al. describe these materials as being "compliant," they mean "mechanically compliant"; however, these materials are also acoustically compliant. One may infer from Guillot et al. a general principle that some acoustically compliant materials are more active in response to higher acoustic frequencies and are less active in response to lower acoustic frequencies. The acoustically compliant materials discussed by Guillot et al. tend to be less responsive at lower acoustical frequencies and more responsive at higher acoustical frequencies.

FIG. 3 and FIG. 4 show the same relationships, generally illustrative of how the sensitivity of a pressure sensor 12 tends to increase in accordance with increasing acoustical frequencies, whereas the sensitivity of a motion sensor 14 tends to decrease in accordance with increasing acoustical frequencies. According to typical inventive practice, a group of pressure sensors 12 is sensitive to a lower range of acoustic frequencies, whereas a group of motion sensors 14 is sensitive to a higher range of acoustic frequencies. As depicted in FIG. 3 and FIG. 4, these lower and higher frequency ranges do not necessarily intersect but can merely be contiguous, depending on the inventive embodiment. Pressure sensors 12 operate effectively in functionality range A. Motion sensors 14 operate effectively in functionality range B.

The sensitivities of the motion sensors and pressure sensors are graphically shown to differ in FIG. 3 and FIG. 4. In FIG. 3, the respective functionality ranges of the motion sensors (high frequency functionality range B) and the pressure sensors (low frequency functionality range A) touch but do not overlap. In FIG. 4, the respective functionality ranges of the motion sensors (high frequency functionality range B) and pressure sensors (low frequency functionality range A) overlap so as to form three distinguishable ranges in terms of effective operation, viz.: (i) an "exclusive" low frequency functionality range I, in which the pressure sensors 12 (but not the motion sensors 14) work well; (ii) an "exclusive" high frequency functionality range II, in which the motion sensors 14 (but not the pressure sensors 12) work well; and, (iii) an "inclusive" mid-frequency functionality range III, in which both the motion sensors 14 and the pressure sensors 12 work well. Frequency range III shown in FIG. 4 represents the intersection of frequency range A and frequency range B. In the case of either FIG. 3 or FIG. 4, a broad frequency continuum of coverage is afforded by inventive practice.

With some discrepancies (depending on the conventional authority), acoustical frequency ranges are conventionally delineated along the following lines: 250 Hz and below =low (lower) frequency sounds; 250 Hz to 6 kHz=middle (mid) frequency sounds; 6 kHz and above=high (higher) frequency sounds. The instant disclosure uses the terms "low frequency" and "high frequency" as relative to each other, and similarly uses the terms "lower frequency" and "higher frequency" as relative to each other. Usual inventive practice will provide for pressure sensors that are sensitive to sound in at least a portion of the conventional low frequency range (250 Hz and below) and in at least a portion of the conventional middle range (250 hertz to 6 kilohertz), and motion sensors that are sensitive to sound in at least a portion of the conventional high frequency range (6 kHz and above) and in at least a portion of the conventional middle range (250 hertz to 6 kilohertz). Nevertheless, when terms such as "low frequency," "lower frequency," "high frequency" and "higher frequency" are used herein in relation to inventive practice, these terms are not intended to be demarcated by the abovementioned conventional frequency delineations.

Figure 5:
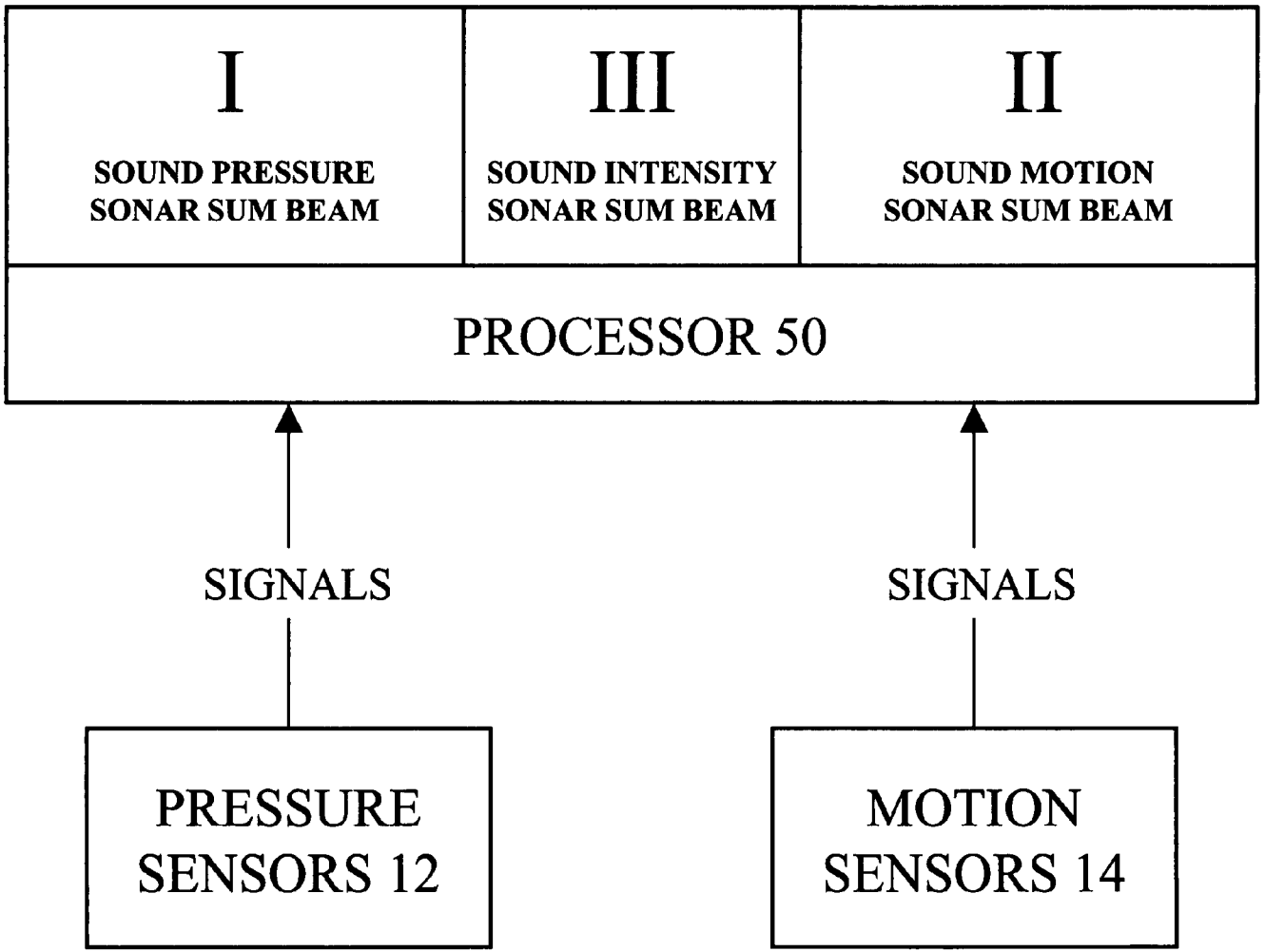
FIG. 5 is a block diagram illustrating the processing of signals generated by pressure sensors and motion sensors, in accordance with frequent inventive practice.

Still referring to FIG. 4 and also referring to FIG. 5, according to typical inventive practice a computer processor 50 receives and processes signals (forms directional sonar beams) from pressure sensors 12 and motion sensors 14. According to some inventive embodiments, the nature of the sound measurement depends on whether the sound frequency falls within functionality range I, or functionality range II, or functionality range III. In functionality range I (the frequency region where only pressure sensors 12 are effective) and in functionality range II (the frequency region where only motion sensors 14 are effective), it may be preferable that processor 50 determine sound pressure (Range I) or sound motion (Range II), which are more typical forms of sound measurement in sonar applications than is sound intensity. However, in functionality range III (the frequency region where both pressure sensors 12 and motion sensors 14 are effective), it may be preferable that processor 50 determine sound intensity sonar beams, instead of sound pressure. Sound intensity is the multiplication of pressure and motion. Sound intensity is sensitive to sound coming from a particular direction. Here, in functionality range III, processor 50 can measure sound intensity in terms of the product of the incident signals from the pressure sensors 12 and from the motion sensors 14. That is, the sonar beam from pressure sensors 12 can be multiplied with the sonar beam from motion sensors 14. The resultant beam may have lower noise and better signal detection, depending on the degree of correlation (ideally, non-correlation) between the background noise fields corresponding to pressure sensors 12 and motion sensors 14, respectively. In other words, extraneous noises will tend to be filtered out of the received sound computation. Thus, where the motion sensors and pressure sensors overlap in effective frequencies, the sonar sum beams formed from the respective motion sensors and pressure sensors can be multiplied together to result in a low noise sonar beam.

Figure 6:
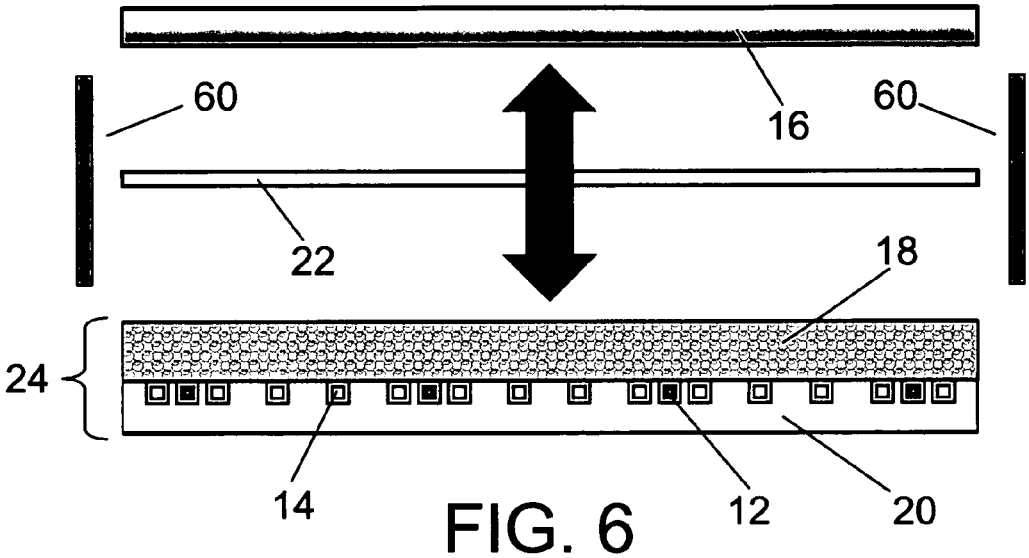
FIG. 6, FIG. 7, FIG. 8 and FIG. 9 are schematics illustrating different inventive methods for installing inventive apparatus onto a marine vessel.
Figure 7:
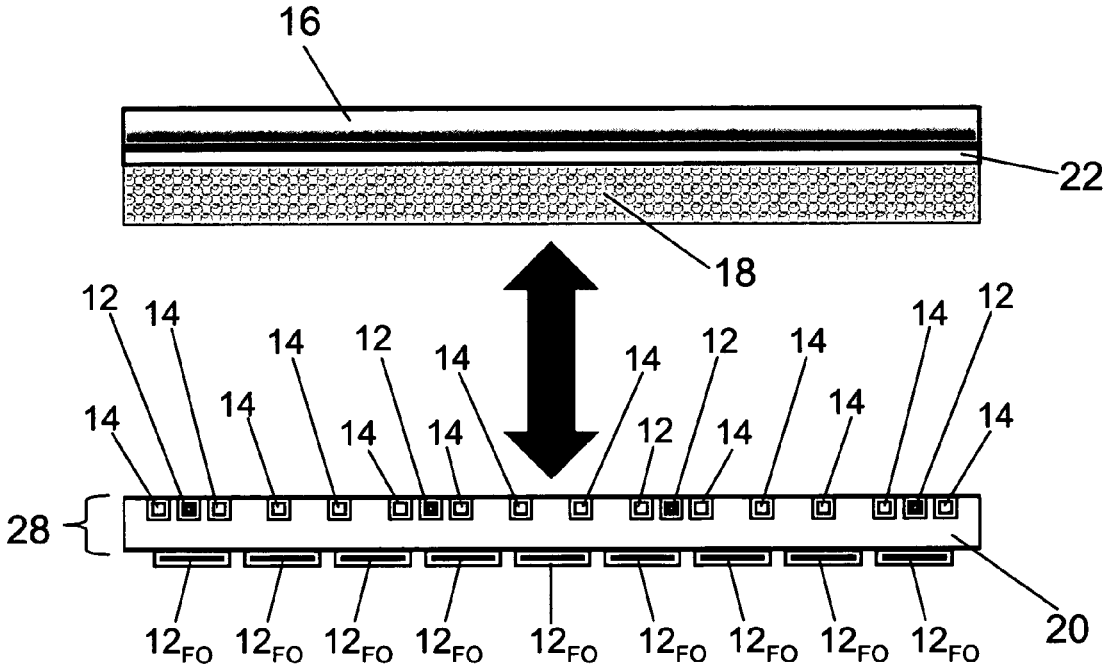
Figure 8:
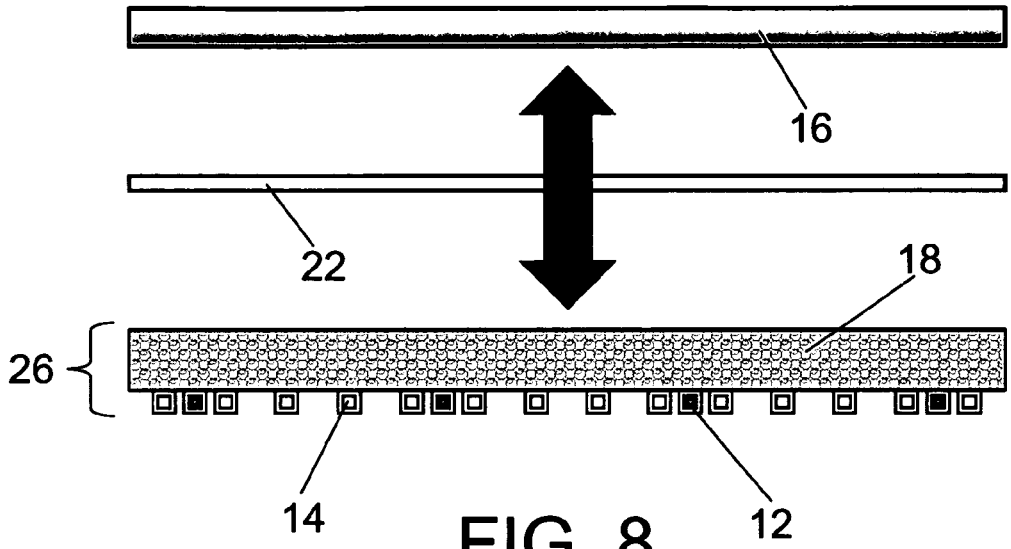

Reference is now made to FIG. 6 through FIG. 9, which illustrate various installation methodologies according to inventive practice. With reference to FIG. 6, many embodiments of the present invention provide functional articles of manufacture in the form of a sheet 24, which includes pressure sensors (hydrophones) 12, motion sensors (geophones) 14, acoustically compliant layer 18 and acoustically transparent layer 20. Sheet 24 can be adhered to a structure such as a ship hull 16 using a separate adhesive material 22. Alternatively, sheet 24 can include an adhesive layer 22 backing for effecting or facilitating such adhesion onto a structure such as a ship hull 16. With reference to FIG. 8, some embodiments of the present invention provide a sheet 26, which includes pressure sensors 12, motion sensors 14 and acoustically compliant layer 18, but which does not include an acoustically transparent layer 20.

Sheets 24 or sheets 26 (or sheets 28, noted hereinbelow) can be rolled up on mandrels, thus rendered portably available for selected deployment on structural surfaces, including but not limited to marine hulls, seawalls and docks. In order for sensor array 10 to operate, sheet 24 or 26 (each of which includes compliant layer 18 and sensor array 10) need not be coupled in an abutting manner (e.g., surface-to-surface) with a structure such as a ship hull 16. Sheet 24 or 26 can be attached to a structure in accordance with any of a variety of attachment techniques using any of a variety of fasteners or other attachment devices, e.g., adhesive, bolts, cables, clamps, hooks, screws, nuts, pins, nails, lugs, brackets, posts, etc. For instance, a portable sheet 24 can be positioned against a seawall, or stretched between two posts 60 (shown in FIG. 6) of a dock, to monitor acoustic activity in a harbor or port (e.g., in furtherance of homeland defense).

Figure 9:
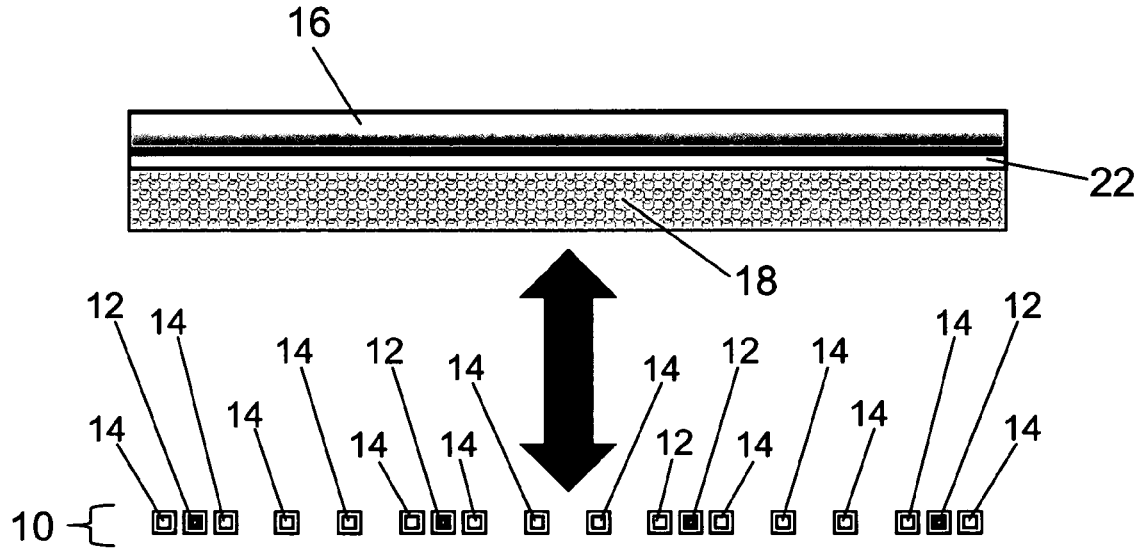

With reference to FIG. 7 and FIG. 9, ship hull 16 is shown to be already provided with an acoustically compliant layer 18. The inventive sensing apparatus can be coupled with ship hull 16 in any of various ways. For instance, pressure sensors 12 and motion sensors 14 can be flush-mounted on the existing acoustically compliant layer 18 such as shown in FIG. 9; subsequently, if the invention is embodied so as to include a transparent layer 20, the transparent layer 20 can be deposited over acoustically compliant layer 18 and cured so as to enclose or encompass pressure sensors 12 and motion sensors 14. As an alternative, a functional article such as a sheet 28 shown in FIG. 7, manufactured so as to include pressure sensors 12, motion sensors 14 and acoustically transparent layer 20 (which encloses or encompasses pressure sensors 12 and motion sensors 14), can be directly applied to the existing acoustically compliant layer 18.

FIG. 1, FIG. 2, FIG. 6 and FIG. 7 depict the same array 10 of four pressure sensors 12 and fourteen motion sensors 14. The arrangement shown is merely illustrative, representing but one example of the practically infinite arrays 10 that are possible in inventive practice. The present invention admits of extreme diversity in terms of numbers and configurations of sensors 12 and 14. For instance, any number of pressure sensors 12 and any number of motion sensors 14 can be aligned horizontally, vertically or diagonally, or distributed irregularly. A longitudinal array 10 can extend, for example, along all or part of the length of a hull 16. Any number of arrays 10 can be inventively implemented with respect to the same structure 16. In accordance with usual inventive practice, the pressure sensors 12 are spaced farther apart than are the motion sensors 14, wherein both the motion sensors 14 and the pressure sensors 12 are spaced proportional to the one-fourth (¼) wavelength of the highest desired sensing frequency. For instance, submarine applications, by virtue of the prolate spheroidal shape of a typical submarine, are particularly well suited for circumferential arrayal of sensors 12 and 14. One possibility in this regard is to situate motion sensors 14 on the submarine hull 16 in one or more (e.g., coaxial) annular arrangements, and to linearly (e.g., longitudinally) situate pressure sensors 12 in one or more (e.g., parallel) linear arrangements.

As noted hereinabove, the present invention can be practiced in the absence of acoustically transparent layer 20, particularly if inventive array 10 (including pressure sensors 12 and motion sensors 14) is shaped so as to minimize hydrodynamic and geodynamic penalties. Fiber optic sensors lend themselves to being more compact, more flow insensitive, and more easily configurable for producing a "flatter" inventive array 10 characterized by less flow noise and less hydrodynamic drag. Moreover, the present invention can be practiced in combination with conventional towed sensor array technology, such as typified by the U.S. Navy's TB-16 towed sensor array. For instance, the present invention can provide for installation of a towed array of pressure sensors 12, instead of or in addition to a hull array of pressure sensors 12; such inventive configurations allow for the use of conventional towed array sensors and beamformers for at least part of the present sensing component of the present invention.

Fiber optic sensors (e.g., "flat" fiber optic sensing devices) can be beneficially implemented regardless of whether the present invention is embodied so as to include a transparent layer 20. Vohra et al. U.S. Pat. No. 6,328,837 B1 issued 11 Dec. 2001, incorporated herein by reference, disclose a fiber optic accelerometer that is suitable for many inventive embodiments; see also, Vohra et al. U.S. Pat. No. 6,056,032 issued 2 May 2000, incorporated herein by reference; Vohra et al. U.S. Pat. No. 5,903,349 issued 11 May 1999, incorporated herein by reference. Also often suitable for inventive practice are fiber optic pressure sensors disclosed by Fisher et al. U.S. Pat. No. 6,229,762 B1 issued 8 May 2001, incorporated herein by reference; Fisher U.S. Pat. No. 5,696,736 issued 9 Dec. 1997, incorporated herein by reference; Fisher U.S. Pat. No. 5,155,707 issued 13 Oct. 1992, incorporated herein by reference; and, Fisher U.S. Pat. No. 5,140,559 issued 18 Aug. 1992, incorporated herein by reference.

Fluid dynamically shaped (e.g., low profile) sensors are especially propitious when the sensors are exposed to the surroundings, such as is exemplified by the present invention's sheet 26, shown in FIG. 8, which includes a sensor array 10 and an acoustically compliant layer 18 but excludes an acoustically transparent layer 20. In accordance with some inventive embodiments, low flow noise fiber optic pressure sensors $\mathbf{12}_{FO}$ are installed on the outside of transparent layer 20, such as shown in FIG. 7; with reference to FIG. 7, the low flow noise fiber optic pressure sensors $\mathbf{12}_{FO}$ that are externally situated can be conceived to be used instead of (or in addition to) the pressure sensors 12 that are embedded in transparent layer 20. In the absence of the present invention's transparent layer 20, lower profile sensors 12 and 14 will carry less flow interaction and thus will afford lesser amounts of drag and noise. For inventive embodiments that include a transparent layer 20, the lower profile sensors 12 and 14 that are embedded in transparent layer 20 will permit a thinner and hence a lighter weight and more economical transparent layer 20.

The present invention typically provides for the mounting (e.g., flush-mounting) of pressure sensors 12 and motion sensors 14 on acoustically compliant layer 18. The following U.S. Navy technical report, incorporated herein by reference, is informative about theoretical principles pertaining to the mounting of pressure and velocity sensors on mechanically compliant material: Gideon Maidanik and K. J. Becker, "Normalized Outputs to Turbulent Boundary Layer (TBL) of Pressure and Velocity Transducers and Their Sensitivities," NSWCCD-70-TR-2000/037, March 2000, Naval Surface Warfare Center, Carderock Division, West Bethesda, Md.

The present invention is not to be limited by the embodiments described or illustrated herein, which are given by way of example and not of limitation. Other embodiments of the present invention will be apparent to those skilled in the art from practice of the present invention or from consideration of this disclosure. Various omissions, modifications and changes to the principles described herein may be made by one skilled in the art without departing from the true scope and spirit of the present invention, which is indicated by the following claims.

What is claimed is:

1. Acoustical sensing apparatus comprising a sheet including an acoustically compliant layer, said apparatus further comprising, adjoining said acoustically compliant layer, at least one pressure sensor and at least one motion sensor, said at least one pressure sensor being capable of sensing pressure of sound waves encountered by said at least one pressure sensor, said at least one motion sensor being capable of sensing vibration of said acoustically compliant layer, said vibration being associated with sound waves encountered by said acoustically compliant layer, wherein said sheet is a laminar sheet including said acoustically compliant layer and an acoustically transparent layer, and wherein said at least one pressure sensor and said at least one motion sensor are embedded in said acoustically transparent layer.

2. The acoustical sensing apparatus of claim 1, wherein said sensing of said pressure includes generating an electrical signal in response to said pressure, and wherein said sensing of said vibration includes generating an electrical signal in response to said vibration.

3. The acoustical sensing apparatus of claim 1, wherein said at least one motion sensor is functionally connected to said acoustically compliant layer for said sensing of said vibration.

4. The acoustical sensing apparatus of claim 1, wherein:

said at least one pressure sensor is capable of sensing said pressure of sound waves in a first continuous frequency range of said sound waves encountered by said at least one pressure sensor;

said at least one motion sensor is capable of sensing said vibration in a second continuous frequency range of said sound waves encountered by said acoustically compliant layer;

at least a portion of said second continuous frequency range is higher than said first continuous frequency range;

the combination of said first continuous frequency range and said second continuous frequency range establishes a continuous broadband frequency range.

5. The acoustical sensing apparatus of claim 1, wherein:

said at least one pressure sensor is capable of sensing said pressure of sound waves in a first continuous frequency range of said sound waves encountered by said at least one pressure sensor;

said at least one motion sensor is capable of sensing said vibration in a second continuous frequency range of said sound waves encountered by said acoustically compliant layer;

a portion of said first continuous frequency range and a portion of said second continuous frequency range intersect, said intersection defining a common frequency range;

the combination of said first continuous frequency range and said second continuous frequency range establishes a continuous broadband frequency range;

said apparatus further comprises means for processing signals generated by said at least one pressure sensor and said at least one motion sensor;

said processing includes determination of sound intensity based on the product of said signals generated by said at least one pressure sensor and said at least one motion sensor; and said determination of sound intensity pertains to sound waves in said common frequency range.

6. The acoustical sensing apparatus of claim 1, wherein said at least one motion sensor includes at least one sensor selected from the group consisting of velocity sensor, acceleration sensor, and paired pressure sensor device.

7. The acoustical sensing apparatus of claim 1, said apparatus further comprising an adhesive layer for disposition between said acoustically compliant layer and at least a portion of a structure.

8. The acoustical sensing apparatus of claim 7, wherein said structure is a marine hull.

9. An acoustical detection system comprising:

an array of plural hydrophones and plural geophones; and an acoustically compliant structure upon which said array is mounted;

each said hydrophone detecting pressure resulting from acoustical propagation in a hydrophonic acoustical frequency range, each said geophone detecting vibration of said acoustically compliant structure resulting from acoustical propagation in a geophonic acoustical frequency range at least partly exceeding said hydrophonic acoustical frequency range, said hydrophonic acoustical frequency range and said geophonic acoustical frequency range together constituting a broadband acoustical frequency range that is greater than either one of said acoustical frequency range and said geophonic acoustical frequency range.

10. The acoustical detection system of claim 9, said system further comprising an acoustically transparent structure abutting said acoustically compliant structure and containing said array.

11. The acoustical detection system of claim 10, wherein said acoustically compliant structure is at least substantially composed of a voided elastic material.

12. The acoustical detection system of claim 10, wherein said acoustically transparent structure is at least substantially composed of a material selected from the group consisting of plastic material and rubber material.

13. The acoustical detection system of claim 10, said system further comprising a supportive structure to which is attached said acoustically compliant structure.

14. The acoustical detection system of claim 13, wherein said supportive structure is a rigid structure at least substantially composed of a material selected from the group consisting of metal and composite.

15. The acoustical detection system of claim 13, said system further comprising an adhesive structure for said attachment of said acoustically compliant structure to said supportive structure.

16. The acoustical detection system of claim 15, wherein said adhesive structure is at least substantially composed of a polyurethane material.

17. A method for attributing a structure with acoustical sensing capability, said method comprising coupling, with said structure, apparatus comprising a sheet, at least one motion sensor and at least one pressure sensor, said sheet including an acoustically compliant layer, each said pressure sensor and each said motion sensor being attached to said acoustically compliant layer, each said pressure sensor having the capability of sensing pressure of sound waves encountered by said pressure sensor, each said motion sensor having the capability of sensing vibration of said acoustically compliant layer resulting from sound waves encountered by said acoustically compliant layer, said at least one pressure sensor having the capability of sensing pressure of sound waves in a first continuous frequency range, said at least one motion sensor having the capability of sensing vibration resulting from sound waves in a second continuous frequency range at least a portion of which is higher than said first continuous frequency range, said first continuous frequency range and said second continuous frequency range combining to establish a continuous broadband frequency range.

18. The method for attributing of claim 17, wherein said sheet is a laminar sheet including said acoustically compliant layer and an acoustically transparent layer, and wherein each said pressure sensor and each said motion sensor is enclosed in said acoustically transparent layer.

19. The method for attributing of claim 17, wherein said coupling of said apparatus with said structure includes adhering said compliant layer to a surface area of said structure, and wherein said adhering includes situating a polyurethane layer between said acoustically compliant layer and said surface area of said structure.

* * * * *